US010279586B2

(12) United States Patent
Kimura et al.

(10) Patent No.: US 10,279,586 B2
(45) **Date of Patent: *May 7, 2019**

(54) METHOD OF PRINTING TEST PATTERN AND PRINTER

(71) Applicant: BROTHER KOGYO KABUSHIKI KAISHA, Nagoya-shi, Aichi-ken (JP)

(72) Inventors: Aya Kimura, Nagoya (JP); Toshio Sugiura, Anjo (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/470,428

(22) Filed: Mar. 27, 2017

(65) Prior Publication Data

US 2018/0072081 A1 Mar. 15, 2018

(30) Foreign Application Priority Data

Sep. 9, 2016 (JP) ..... 2016-176932

(51) Int. Cl.
*B41J 29/393* (2006.01)
*B41J 2/125* (2006.01)
(Continued)

(52) U.S. Cl.
CPC ..... *B41J 2/125* (2013.01); *B41J 2/195* (2013.01); *B41J 2/2135* (2013.01); *B41J 29/38* (2013.01); *B41J 2029/3935* (2013.01)

(58) Field of Classification Search
CPC ... B41J 2/125; B41J 29/38; B41J 2/195; B41J 2/2135; B41J 2029/3935
See application file for complete search history.

(56) References Cited

U.S. PATENT DOCUMENTS

2003/0133492 A1* 7/2003 Watanabe ..... B41J 2/04528 374/179
2007/0140771 A1* 6/2007 Yanagi ..... B41J 11/46 400/578
(Continued)

FOREIGN PATENT DOCUMENTS

JP 2002-225238 A 8/2002
JP 2009-297968 A 12/2009
(Continued)

OTHER PUBLICATIONS

Related U.S. Appl. No. 15/470,264, filed Mar. 27, 2017.
(Continued)

*Primary Examiner* — Yaovi M Ameh
(74) *Attorney, Agent, or Firm* — Scully, Scott, Murphy & Presser, P.C.

(57) ABSTRACT

A method of printing a test pattern in a printer includes printing a related-information acquisition pattern as the test pattern in a particular state by driving a plurality of drive elements of a liquid ejection head to eject a liquid droplet from a plurality of nozzles based on a temperature detected by a temperature sensor. The related-information acquisition pattern is a pattern for acquiring related information relating to at least one of an ejection amount and a liquid droplet landing position of the liquid droplet ejected from each of the plurality of nozzles. The liquid droplet landing position is a position at which the liquid droplet ejected from each of the plurality of nozzles lands on a recording medium. The particular state is a state where a temperature difference between the temperature detected by the temperature sensor and an actual temperature of the liquid ejection head is constant.

18 Claims, 8 Drawing Sheets

(51) Int. Cl.

| | |
|---|---|
| ***B41J 2/195*** | (2006.01) |
| ***B41J 2/21*** | (2006.01) |
| ***B41J 29/38*** | (2006.01) |

(56) References Cited

U.S. PATENT DOCUMENTS

| | | | | |
|---|---|---|---|---|
| 2010/0156977 | A1* | 6/2010 | Kanematsu | B41J 19/145 347/14 |
| 2011/0249053 | A1 | 10/2011 | Makita et al. | |
| 2012/0194591 | A1 | 8/2012 | Hagiwara | |
| 2012/0249639 | A1 | 10/2012 | Ozawa et al. | |
| 2018/0072050 | A1* | 3/2018 | Kimura | B41J 2/0454 |
| 2018/0072081 | A1 | 3/2018 | Kimura et al. | |

FOREIGN PATENT DOCUMENTS

| | | | |
|---|---|---|---|
| JP | 2012-158140 | A | 8/2012 |
| JP | 2016-043634 | A | 4/2016 |

OTHER PUBLICATIONS

U.S. Notice of Allowance dated Oct. 10, 2018 from related U.S. Appl. No. 15/470,264, filed Mar. 27, 2017.
Office Action dated May 11, 2018 from related U.S. Appl. No. 15/470,264, filed Mar. 27, 2017.

* cited by examiner

METHOD OF PRINTING TEST PATTERN AND PRINTER

CROSS REFERENCE TO RELATED APPLICATIONS

This application claims priority from Japanese Patent Application No. 2016-176932 filed Sep. 9, 2016. The entire content of the priority application is incorporated herein by reference.

TECHNICAL FIELD

This disclosure relates to a method of printing a test pattern in a printer that performs printing by ejecting liquid from nozzles, and to a printer that performs printing by ejecting liquid from nozzles.

BACKGROUND

An inkjet printer as an example of a printer is known that performs printing by ejecting liquid from nozzles. The inkjet printer is a so-called a serial type and can perform bidirectional printing. The inkjet printer prints a plurality of ruled-line patterns, and allows a user to select a suitable ruled-line pattern among the plurality of ruled-line patterns. By determining ejection timing based on the selected ruled-line pattern, deviation of droplet landing positions in a scanning direction at the time when a print head is moved to one side of the scanning direction and when the print head is moved to the other side is suppressed in bidirectional printing.

SUMMARY

According to one aspect, this specification discloses a method of printing a test pattern in a printer including: a liquid ejection head having a plurality of nozzles and a plurality of drive elements configured to cause the plurality of nozzles to eject a liquid droplet; a heat generator that generates heat when the plurality of drive elements is driven; and a temperature sensor configured to detect a temperature of the liquid ejection head. The method includes printing a related-information acquisition pattern as the test pattern in a particular state by driving the plurality of drive elements to eject a liquid droplet from the plurality of nozzles based on the temperature detected by the temperature sensor. The related-information acquisition pattern is a pattern for acquiring related information relating to at least one of an ejection amount and a liquid droplet landing position of the liquid droplet ejected from each of the plurality of nozzles. The liquid droplet landing position is a position at which the liquid droplet ejected from each of the plurality of nozzles lands on a recording medium. The particular state is a state where a temperature difference between the temperature detected by the temperature sensor and an actual temperature of the liquid ejection head is constant.

According to another aspect, this specification also discloses a printer. The printer includes a liquid ejection head, a heat generator, a temperature sensor, and a controller. The liquid ejection head has a plurality of nozzles and a plurality of drive elements configured to cause the plurality of nozzles to eject a liquid droplet. The temperature sensor is configured to detect a temperature of the liquid ejection head. The controller is configured to drive the plurality of drive elements to eject the liquid droplet from the plurality of nozzles based on a temperature detected by the temperature sensor. The heat generator generates heat when the plurality of drive elements is driven. The controller is configured to: perform a determining process of determining whether the printer is in a first state where a temperature difference between the temperature detected by the temperature sensor and an actual temperature of the liquid ejection head is constant or in a second state where the temperature difference varies with time; and a pattern printing process of, after determining that the printer is in the first state in the determining process, controlling the liquid ejection head to print a related-information acquisition pattern as a test pattern. The related-information acquisition pattern is a pattern for acquiring related information relating to at least one of an ejection amount and a liquid droplet landing position of the liquid droplet ejected from each of the plurality of nozzles. The liquid droplet landing position is a position at which a liquid droplet ejected from each of the plurality of nozzles lands on a recording medium.

It is normally in the first state when printing is performed by the printer. Hence, a test pattern is printed by the printer and, based on the print results, various adjustments are performed in the first state. The printer is sometimes not in the first state, for example, just after start of driving drive elements. The actual temperature of the liquid ejection head relative to the temperature detected by the temperature sensor is different between the first state and a state that is not the first state. When the temperature of the liquid ejection head changes, the viscosity of liquid in the liquid ejection head changes and an ejection amount and ejection speed of liquid from the nozzles also change. When the ejection speed changes, a liquid droplet landing position changes. Hence, if a test pattern for acquiring information relating to the ejection amount and liquid droplet landing position of liquid is printed in a state that is not the first state and if the ejection amount and liquid droplet landing position in the first state are adjusted based on the print results, the ejection amount and liquid droplet landing position of liquid droplet in the first state cannot be adjusted appropriately.

In this disclosure, the test pattern for acquiring information relating to the ejection amount or liquid droplet landing position of liquid from the nozzles is printed in the first state. Thus, the ejection amount, droplet landing position, and so on, of liquid in the first state can be adjusted appropriately based on the printed test pattern.

BRIEF DESCRIPTION OF THE DRAWINGS

Embodiments in accordance with this disclosure will be described in detail with reference to the following figures wherein.

DETAILED DESCRIPTION

The inventors of this disclosure found that, when a liquid ejection head is continued to be driven, the inkjet printer eventually becomes a first state where a temperature difference between a temperature detected by a temperature sensor and an actual temperature of the liquid ejection head is constant, and before becoming the first state, a period of a second state exists where the temperature difference between the temperature detected by the temperature sensor and the actual temperature of the liquid ejection head varies with time.

In the above-mentioned inkjet printer, as the temperature in the print head changes, the viscosity of liquid in the print head changes and the ejection speed of liquid changes. Thus, in the above-mentioned inkjet printer, when a ruled-line pattern is printed in the second state, droplet landing positions of liquid in the printed ruled-line pattern are deviated in the scanning direction from droplet landing positions when printing is performed in the first state. As a result, if the ruled-line pattern is printed in the second state and ejection timing is determined based on the selected ruled-line pattern, the determined ejection timing is not an appropriate ejection timing in the first state.

Further, if the viscosity of liquid in the liquid ejection head changes, the ejection amount of liquid from a nozzle changes. Thus, for example, if a test pattern for adjusting an ejection amount of liquid is printed in the second state and the ejection amount of liquid is adjusted based on the print results of this test pattern, there is a possibility that the ejection amount of liquid is not appropriate in the first state.

An example of an object of this disclosure is to provide a method of printing a test pattern for appropriately adjusting droplet landing positions and ejection amounts of liquid, and to provide a printer.

An aspect of this disclosure will be described while referring to the accompanying drawings.

<Overall Configuration of Printer>

Figure 1:
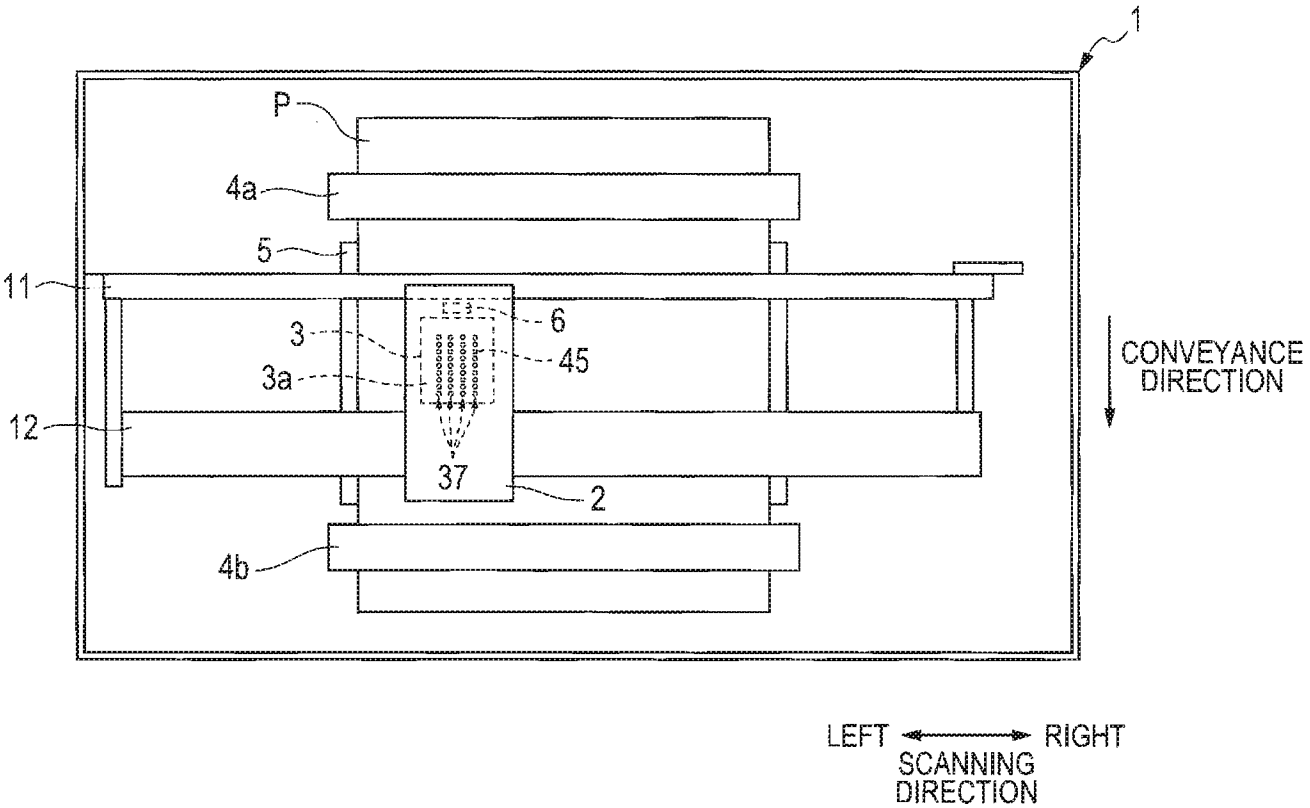
FIG. 1 is a schematic diagram of a printer according to an embodiment of this disclosure.

As shown in FIG. 1, a printer 1 (an example of a printer) according to the embodiment includes a carriage 2, an inkjet head 3 (an example of a liquid ejection head), conveying rollers 4*a*, 4*b*, a platen 5, a medium sensor 6 (an example of a medium sensor), and so on. The carriage 2 is supported by two guide rails 11, 12 extending in a scanning direction, movably in the scanning direction. The carriage 2 is connected to a carriage motor 76 (see FIG. 4) via a belt (not shown) or the like and moves in the scanning direction when the carriage motor 76 is driven. In the embodiment, combination of the carriage 2 and the carriage motor 76 and so on for moving the carriage 2 in the scanning direction serves as a head moving device. Hereinafter, descriptions will be made by defining a right side and a left side of the scanning direction as shown in FIG. 1.

The inkjet head 3 is mounted on the carriage 2 and ejects ink from a plurality of nozzles 45 formed on a nozzle surface 3*a* that is a lower surface of the carriage 2. The conveying roller 4*a* is located at an upstream side of the inkjet head 3 in a conveyance direction perpendicular to the scanning direction. The conveying roller 4*b* is located at a downstream side of the inkjet head 3 in the conveyance direction. The conveying rollers 4*a*, 4*b* are connected to a conveying motor 77 (see FIG. 4) via a gear and so on (not shown). When the conveying motor 77 is driven, the conveying rollers 4*a*, 4*b* rotate to convey a recording sheet P in the conveyance direction. In the embodiment, combination of the conveying rollers 4*a*, 4*b* and the conveying motor 77 and so on for rotating the conveying rollers 4*a*, 4*b* serves as a conveyor.

The platen 5 is located between the conveying roller 4*a* and the conveying roller 4*b* in the conveyance direction. The platen 5 is located at a lower side of the inkjet head 3 and faces the nozzle surface 3*a*. The platen 5 supports, from downward, a part of a recording sheet P facing the nozzle surface 3*a*, the recording sheet P being conveyed by the conveying rollers 4*a*, 4*b*. The medium sensor 6 is mounted on the carriage 2 in a part at the upstream side of the inkjet head 3 in the conveyance direction.

The medium sensor 6 detects a leading end of a recording sheet P that is fed from a sheet tray (not shown) and is conveyed to proximity of the inkjet head 3. The medium sensor 6 acquires luminance based on a light amount of reflection light of light emitted toward the platen 5, for example. Here, the platen 5 has a black color. Before the recording sheet P reaches the medium sensor 6, light emitted from the medium sensor 6 hits the black platen 5, and hence the light amount of reflection light is small and the acquired luminance is small. In contrast, after the leading end of the recording sheet P reaches a position facing the medium sensor 6, light emitted from the medium sensor 6 hits the white recording sheet P. Hence, the light amount of reflection light is large and the acquired luminance is large. By using this, the medium sensor 6 detects the leading end of the recording sheet P based on the acquired luminance.

<Inkjet Head>

Figure 2:
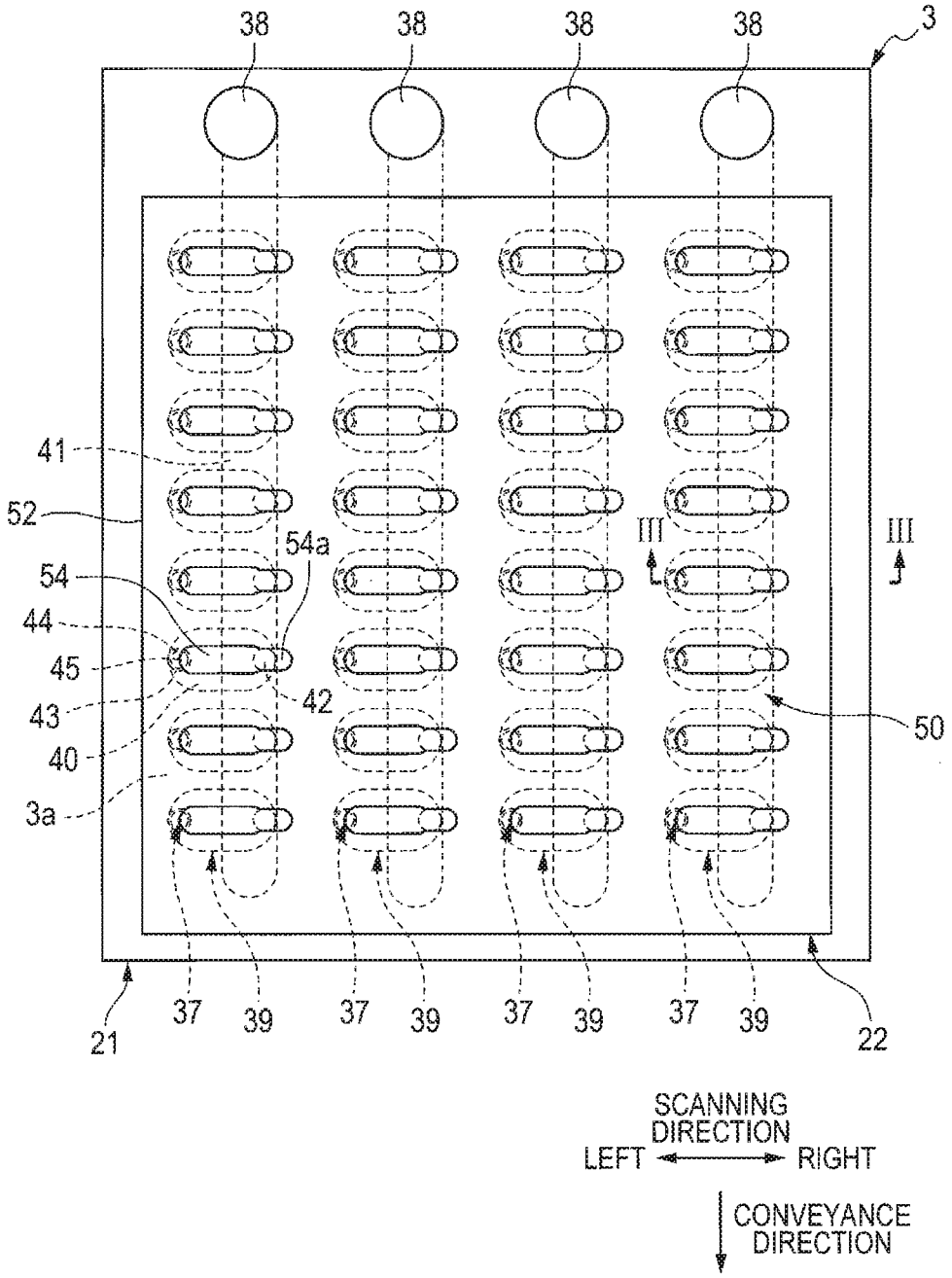
FIG. 2 is a plan view of an inkjet head.
Figure 3:
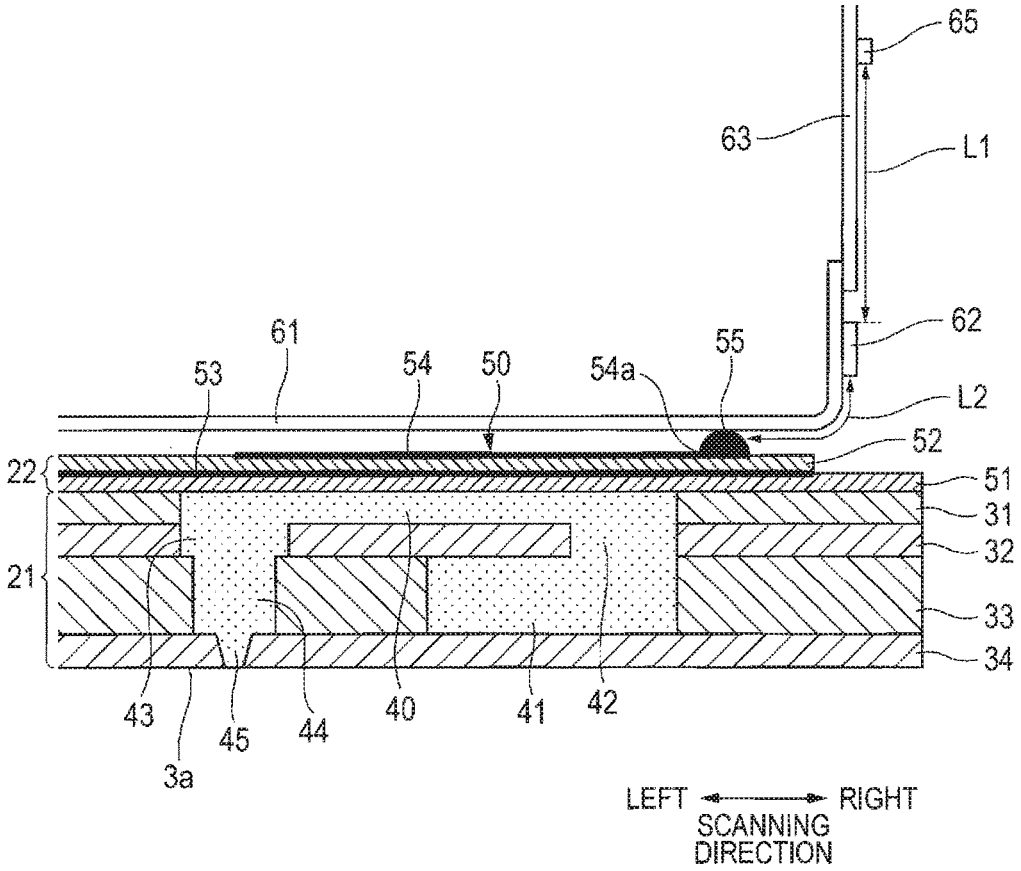
FIG. 3 is a cross-sectional view taken along a line of FIG. 2.

Next, a structure of the inkjet head 3 will be described. As shown in FIG. 2 and FIG. 3, the inkjet head 3 has a channel unit 21 and a piezoelectric actuator 22.

<Channel Unit>

The channel unit 21 is formed of four plates 31 to 34 that are laminated vertically. Among the four plates 31 to 34, the upper three plates 31 to 33 are formed of a metal material such as stainless steel and the lowest plate 34 is formed of a synthetic resin material such as polyimide.

In the plate 31, a plurality of pressure chambers 40 are formed. The pressure chambers 40 have a substantially elliptical shape elongated in the scanning direction in a plan view. The plurality of pressure chambers 40 form pressure chamber arrays 39 by being arranged in the conveyance direction. In the plate 31, four pressure chamber arrays 39 arranged in the scanning direction are formed.

In the plate 32, a plurality of through holes 42 having a substantially circular shape is formed in a part overlapping a right end portion of the plurality of pressure chambers 40. In the plate 32, a plurality of through holes 43 having a substantially circular shape is formed in a part overlapping a left end portion of the plurality of pressure chambers 40.

In the plate 33, four manifold channels 41 are formed. The four manifold channels 41 correspond to the four pressure chamber arrays 39. Each manifold channel 41 extends in the conveyance direction across the plurality of pressure chambers 40 forming the corresponding pressure chamber array 39, and overlaps a substantially right half of these pressure chambers 40. Ink is supplied to each manifold channel 41 through an ink supply port 38 formed in an upstream end portion in the conveyance direction. In the plate 33, a plurality of through holes 44 having a substantially circular shape is formed in a part overlapping the plurality of through holes 43.

In the plate 34, a plurality of nozzles 45 is formed in a part overlapping the plurality of through holes 44. The plurality of nozzles 45 is opened in a lower surface of the plate 34 that is the nozzle surface 3*a*. The plurality of nozzles 45 forms nozzle arrays 37 by being arranged in the conveyance direction similarly to the plurality of pressure chambers 40. In the plate 34, four nozzle arrays 37 arranged in the scanning direction are formed. Ink of black, yellow, cyan, and magenta is ejected from the plurality of nozzles 45 in this order from the nozzle array 37 at the right end.

<Piezoelectric Actuator>

The piezoelectric actuator 22 has a vibration plate 51, a piezoelectric layer 52, a common electrode 53, and a plurality of individual electrodes 54. The vibration plate 51 is formed of a piezoelectric material having lead zirconate titanate that is a mixed crystal of lead titanate and lead zirconate, as a main component. The vibration plate 51 is arranged on an upper surface of the channel unit 21 (upper surface of the plate 31). However, the vibration plate 51 may be formed of an insulating material other than the piezoelectric layer, such as a synthetic resin material, unlike the piezoelectric layer 52 described below.

The piezoelectric layer 52 is formed of a piezoelectric material and extends continuously across the plurality of pressure chambers 40 on an upper surface of the vibration plate 51. The common electrode 53 extends continuously across the plurality of pressure chambers 40 between the vibration plate 51 and the piezoelectric layer 52. The common electrode 53 is always kept at a ground potential.

The plurality of individual electrodes 54 is individually provided for the plurality of pressure chambers 40. Each individual electrode 54 has a substantially elliptical shape that is smaller than the pressure chambers 40 in a plan view. Each individual electrode 54 is arranged on the top surface of the piezoelectric layer 52 so as to overlap a center part of the corresponding pressure chamber 40. A right end portion of each individual electrode 54 extends to a right side up to a position not overlapping the pressure chamber 40 and its tip end portion is a connection terminal 54*a*. Bumps 55 formed of a conductive material and protruding upward are arranged on an upper surface of the connection terminal 54*a*. One of a ground potential and a particular driving potential V is selectively applied individually to the plurality of individual electrodes 54, by a driver IC 62 described later.

In the piezoelectric actuator 22 having the above-described configuration, the common electrode 53 and the plurality of individual electrodes 54 are arranged in this way. In connection to this arrangement, a part sandwiched by each individual electrode 54 of the piezoelectric layer 52 and the common electrode 53 are polarized in a thickness direction. Each part overlapping each pressure chamber 40 of the piezoelectric actuator 22 serves as a drive element 50 for ejecting ink from the corresponding nozzle 45.

A method for driving the piezoelectric actuator 22 (the plurality of drive elements 50) to eject ink from the nozzles 45 will be described. In the piezoelectric actuator 22, all individual electrodes 54 are kept at the ground potential preliminarily by the driver IC 62. In order to eject ink from a certain nozzle 45, the potential of the individual electrode 54 that corresponds to the nozzles 45 is switched from the ground potential to the driving potential by the driver IC 62. Then, due to the potential difference between the individual electrode 54 and the common electrode 53, an electric field in a polarization direction is generated in a part of the piezoelectric layer 52 sandwiched by these electrodes, and the part of the piezoelectric layer 52 is contracted in a surface direction perpendicular to the polarizing direction. Thereby, a part of the vibration plate 51 and the piezoelectric layer 52 overlapping the pressure chamber 40 is deformed to be convex toward the pressure chamber 40 as a whole. As a result, the volume of the pressure chamber 40 decreases, and thereby the pressure of ink in the pressure chamber 40 is increased and ink is ejected from the nozzle 45 communicating with the pressure chamber 40.

<COF>

A COF (chip on film) 61 is arranged above the piezoelectric actuator 22. The COF 61 is connected to the plurality of bumps 55. The COF 61 extends to the right side from connection with the plurality of bumps 55 and is bent upward. The driver IC 62 (an example of a heat generator) is mounted on a part of the COF 61 extending vertically. The driver IC 62 is connected to the plurality of individual electrodes 54 via a wiring (not shown) that is formed in the COF 61 and via the bumps 55.

<FPC>

A FPC (flexible printed circuit) 63 is connected to an upper end portion of the COF 61. The FPC 63 extends upward from connection with the COF 61. An end portion of the FPC 63 opposite the COF 61 is connected to a board (not shown) that is connected to a controller 70. A thermistor 65 (an example of a temperature sensor) is arranged at a middle portion of the FPC 63. The thermistor 65 is for detecting temperature of the inkjet head 3.

The inkjet head 3, the driver IC 62, and the thermistor 65 are connected to each other by a wiring member 64 that includes the COF 61 and the FPC 63. The inkjet head 3, the driver IC 62, and the thermistor 65 are arranged as described above. Thus, in a direction in which the wiring member 64 extends, the thermistor 65 is located at the opposite side from the inkjet head 3 with respect to the driver IC 62. As shown in FIG. 3, a length L1 of the wiring member 64 from connection with the thermistor 65 to connection with the driver IC 62 is longer than a length L2 of the wiring member 64 from connection with the inkjet head 3 to connection with the driver IC 62.

<Controller>

Figure 4:
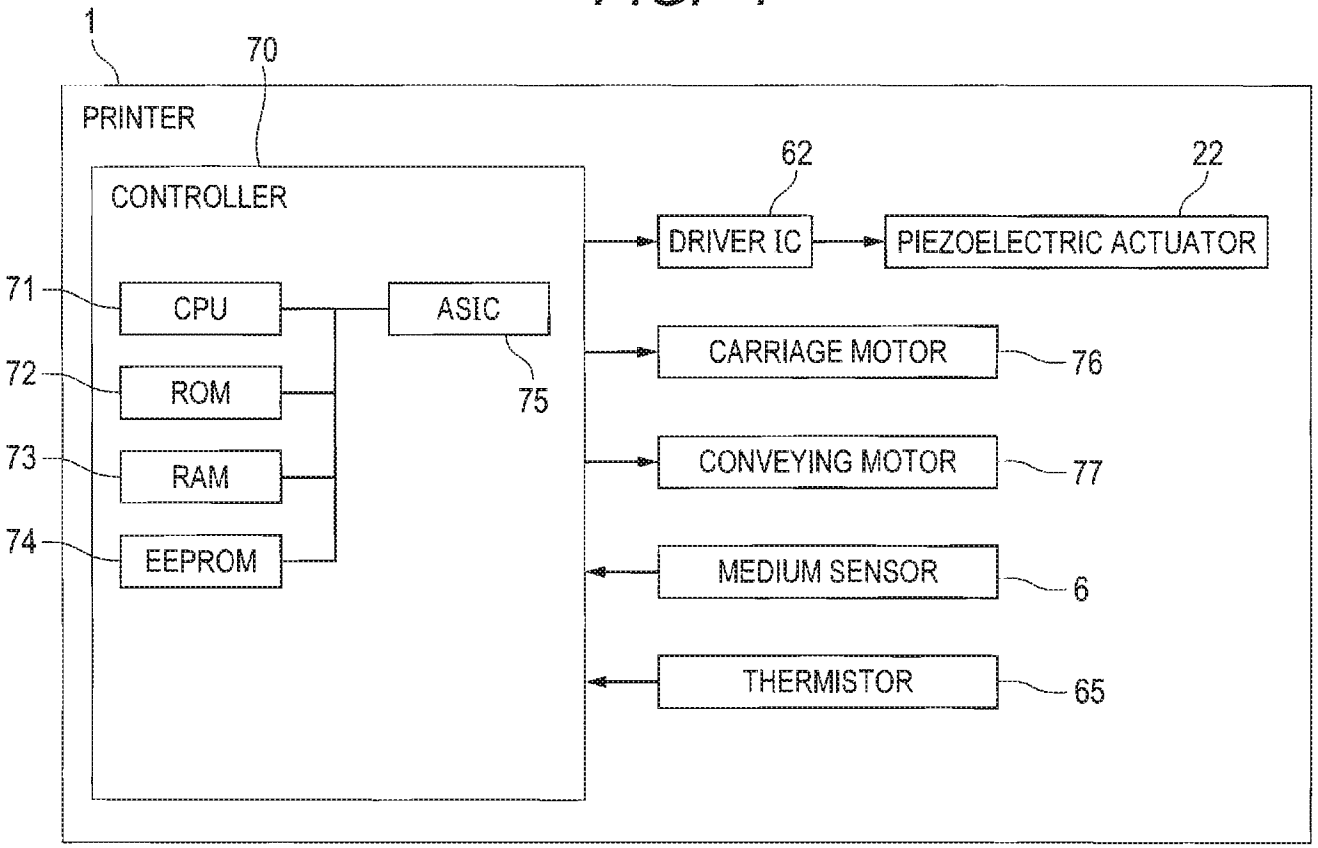
FIG. 4 is a block diagram showing an electrical configuration of the printer.

The controller 70 controls operations of the printer 1. As shown in FIG. 4, the controller 70 includes a CPU (central processing unit) 71, a ROM (read only memory) 72, a RAM (random access memory) 73, an EEPROM (electrically erasable programmable read only memory) 74, an ASIC (application specific integrated circuit) 75, and so on, and these control the carriage motor 76, the driver IC 62, the conveying motor 77, and so on. Signals are inputted to the controller 70 from the medium sensor 6, the thermistor 65, and so on.

FIG. 4 shows only one CPU 71. The controller 70 may include only one CPU 71 and the one CPU 71 may perform processes collectively. The controller 70 may include a plurality of CPUs 71 and the plurality of CPUs 71 may perform processes by sharing. FIG. 4 shows only one ASIC 75. The controller 70 includes only one ASIC 75 and the one ASIC 75 may perform processes collectively. The controller 70 may include a plurality of ASICs 75 and the plurality of ASICs 75 may perform processes by sharing.

<Operation of Printer at the Time of Printing>

Next, operation of the printer at the time of printing will be described.

After the medium sensor 6 detects the leading end of the recording sheet P, the printer 1 performs printing on the recording sheet P by alternately repeating scan printing and conveying of the recording sheet P. In the scan printing, while the carriage 2 is moved in the scanning direction, ink is ejected from the plurality of nozzles 45 of the inkjet head 3. In the conveying of the recording sheet P, the recording sheet P is conveyed in the conveyance direction by the conveying rollers 4*a*, 4*b*. The printer 1 can selectively perform one of bidirectional printing and unidirectional printing. In the bidirectional printing, the plurality of nozzles 45 ejects ink in both when the carriage 2 is moved to the right side and when the carriage 2 is moved to the left side. In the unidirectional printing, the plurality of nozzles 45 ejects ink only when the carriage 2 is moved to the right side or the left side.

<Printing of Test Pattern>

Next, the procedure of printing test patterns for making various adjustments in the printer 1 will be described. For example, at the time of manufacturing the printer 1, a test pattern is printed and adjustments are made based on the print result of the test pattern, as described below. Specifically, when a user operates an operating device (not shown) of the printer 1 or a PC connected to the printer 1 based on the print result of the test pattern, the controller 70 performs adjustments in response to the operation by the user. Or, in a case where the printer 1 is a multifunction peripheral having a scanner and so on, the controller 70 may perform adjustments based on a reading result of the scanner when the test pattern is read by the scanner.

Figure 5:
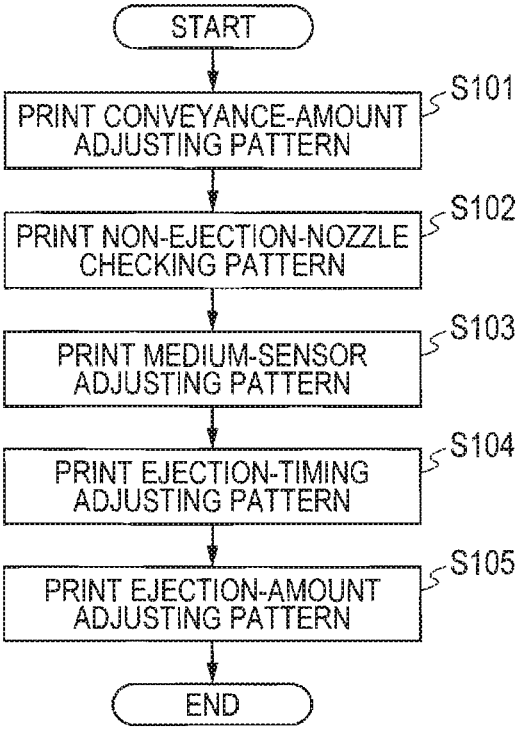
FIG. 5 is a flowchart showing a flow of printing a test pattern.

As shown in FIG. 5, when a test pattern is printed in the printer 1, the controller 70 first controls to print a conveyance-amount adjusting pattern 100 for adjusting the conveyance amount of the recording sheet P by the conveying rollers 4*a*, 4*b* (S101).

Figure 6:
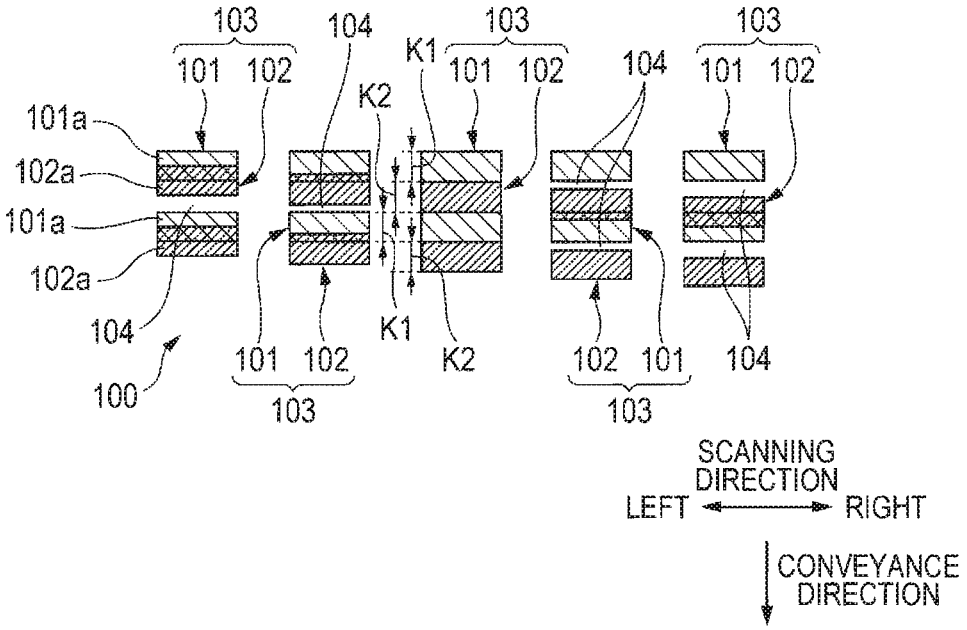
FIG. 6 is a diagram showing a conveyance-amount adjusting pattern.

As shown in FIG. 6, the conveyance-amount adjusting pattern 100 has a plurality of first portions 101 and a plurality of second portions 102 corresponding to the plurality of first portions 101. The plurality of first portions 101 is arranged in the scanning direction. Each first portion 101 is formed by two rectangular portions 101*a*. Each of the two rectangular portions 101*a* is a portion of substantially a rectangular shape having a length K1 in the conveyance direction. The two rectangular portions 101*a* are arranged with an interval therebetween in the conveyance direction. The interval between the two rectangular portions 101*a* in the conveyance direction is K2. Among the plurality of first portions 101, the positions of the rectangular portions 101*a* in the conveyance direction are the same.

The plurality of second portions 102 is located at the same position as the plurality of first portions 101 in the scanning direction. The plurality of second portions 102 is arranged in the scanning direction. Each second portion 102 is formed by two rectangular portions 102*a*. Each of the two rectangular portions 102*a* is a portion of substantially a rectangular shape having a length K2 in the conveyance direction. The two rectangular portions 102*a* are arranged with an interval therebetween in the conveyance direction. The interval between the two rectangular portions 102*a* in the conveyance direction is K1. Among the plurality of second portions 102, the positions of the rectangular portions 102*a* in the conveyance direction are shifted from each other. Specifically, among the plurality of second portions 102, the rectangular portions 102*a* of the second portion 102 at the right side in the scanning direction are located at the downstream side in the conveyance direction. That is, the farther right side the second portion 102 is, the farther downstream side the second portion 102 is.

In order to print the conveyance-amount adjusting pattern 100, first, the plurality of first portions 101 is printed by scan printing. Subsequently, after the recording sheet P is conveyed a particular distance by the conveying rollers 4*a*, 4*b*, the second portion 102 corresponding to the leftmost first portion 101 is printed by scan printing. Subsequently, after the recording sheet P is conveyed a small distance by the conveying rollers 4*a*, 4*b*, the second portion 102 corresponding to the second first portion 101 from the left is printed by scan printing. Likewise, by repeating conveyance of the recording sheet P by a small distance and scan printing, the second portion 102 corresponding to each first portion 101 is printed. By this operation, the conveyance-amount adjusting pattern 100 is printed in which a plurality of sets 103 of the first portion 101 and the second portion 102 is arranged in the scanning direction.

The conveyance-amount adjusting pattern 100 allows selecting, from among the plurality of sets 103, one set 103 having two rectangular portions 101*a* and two rectangular portions 102*a* arranged alternately in the conveyance direction without overlapping, that is, one set 103 having no white streak 104 where ink does not land, between any rectangular portion 101*a* and rectangular portion 102*b* (the third set 103 from the left in the example of FIG. 6). Based on which set 103 is selected, the conveyance amount of the recording sheet P by the conveying rollers 4*a*, 4*b* can be adjusted.

Figure 7:
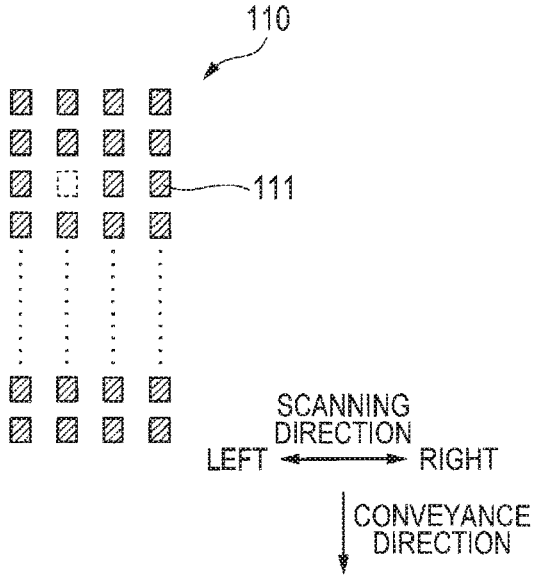
FIG. 7 is a diagram showing a non-ejection-nozzle checking pattern.

Returning to FIG. 5, after printing the conveyance-amount adjusting pattern 100, the controller 70 subsequently controls to print a non-ejection-nozzle checking pattern 110 (S102). As shown in FIG. 7, the non-ejection-nozzle checking pattern 110 is a pattern in which a plurality of portions 111 is arranged in the scanning direction and in the conveyance direction. The arrangement of the plurality of portions 111 corresponds to the arrangement of the plurality of nozzles 45. The portion 111 in the N-th from the left in the scanning direction and in the M-th from the upstream side in the conveyance direction is formed by ink ejected from the nozzle 45 forming the nozzle array 37 in the N-th from the left in the scanning direction and located in the M-th from the upstream side in the conveyance direction.

In the non-ejection-nozzle checking pattern 110, for example, among the plurality of portions 111, the portion 111 corresponding to a non-ejection nozzle that ejects no ink (for example, the portion 111 shown by the dashed lines in FIG. 7) is not printed. Accordingly, in the non-ejection-nozzle checking pattern 110, it can be checked whether there is a non-ejection nozzle in the plurality of nozzles 45, based on whether there is a portion 111 that is not printed. Further, which nozzle 45 is non-ejection nozzle can be grasped based on which portion 111 (specifically, in the N-th from the left in the scanning direction and in the M-th from the upstream side in the conveyance direction) is not printed.

Returning to FIG. 5, after printing the non-ejection-nozzle checking pattern 110, the controller 70 subsequently controls to print a medium-sensor adjusting pattern 120 for adjusting a threshold (sensitivity) of the medium sensor 6 (S103).

Figure 8:
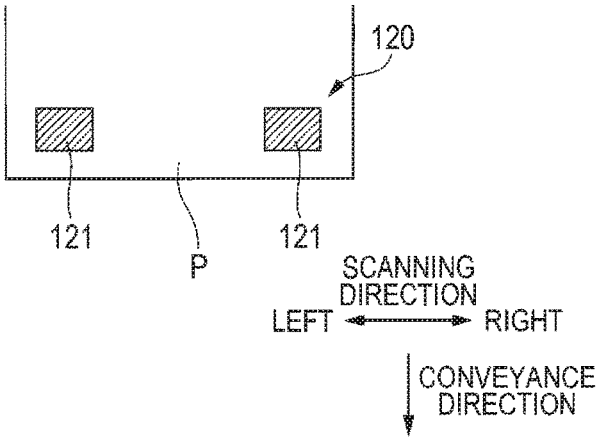
FIG. 8 is a diagram showing a medium-sensor adjusting pattern.

As shown in FIG. 8, the medium-sensor adjusting pattern 120 has two portions 121. The two portions 121 are located at both end portions of the recording sheet P in the scanning direction, and are filled portions formed by black ink. The medium-sensor adjusting pattern 120 is printed by, after the leading end of the recording sheet P is detected by the medium sensor 6, conveying the recording sheet P by a particular conveying amount and ejecting black ink from the plurality of nozzles 45.

In order to adjust the threshold of the medium sensor 6 by using the medium-sensor adjusting pattern 120, the recording sheet P on which the medium-sensor adjusting pattern 120 is printed is set again in the printer 1. After the medium sensor 6 detects the leading end of this recording sheet P and the recording sheet P is conveyed by the above particular amount, the medium sensor 6 is controlled to detect whether the recording sheet P exists while moving the carriage 2 in the scanning direction. At this time, if the set threshold is appropriate, the recording sheet P is not detected when the medium sensor 6 faces the portions 121 at both end portions of the recording sheet P in the scanning direction, and the recording sheet P is detected when the medium sensor 6 faces a center portion of the recording sheet P in the scanning direction where the portions 121 are not printed. In this case, adjustments of the threshold are unnecessary.

On the other hand, if the threshold is too low, the recording sheet P is always detected regardless of whether the medium sensor 6 faces the portion 121. In this case, the threshold is increased. In contrast, if the threshold is too high, the recording sheet P is not detected at all regardless of whether the medium sensor 6 faces the portion 121. In this case, the threshold is decreased.

The sequence of printing the above three patterns 100, 110, and 120 is not limited to the sequence described above. For example, the three patterns 100, 110, and 120 may be printed in a sequence different from the one described above, such as printing in the sequence of the patterns 110, 100, and 120. In the present embodiment, each of the patterns 100, 110, and 120 is an example of "another pattern". The operation for printing the pattern 100, 110, 120 is an example of "preparing operation", and the processing of the controller 70 for performing this operation is an example of "preparing process".

Figure 9:
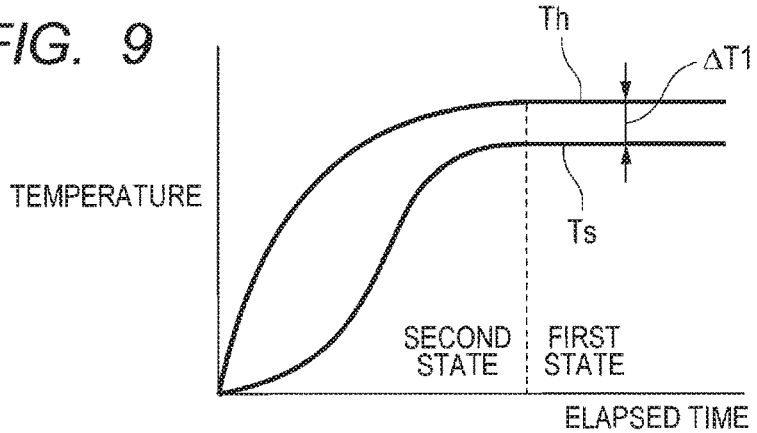
FIG. 9 is a diagram showing a relationship between elapsed time from start of driving of drive elements, and a temperature detected by a thermistor and an actual temperature of the inkjet head.

When the drive elements 50 are driven by the driver IC 62, the driver IC 62 generates heat, heat of the driver IC 62 is transmitted to the inkjet head 3 and the thermistor 65 via the wiring member 64, and a thermistor temperature Ts and a temperature of the inkjet head 3 (hereinafter referred to as "head temperature Th") increase. As shown in FIG. 9, if driving of the drive elements 50 continues, a temperature difference ΔT1 between the thermistor temperature Ts and the head temperature Th becomes constant eventually (the first state). In the embodiment, the actual temperature of the inkjet head 3 is, for example, a temperature of a center part of the nozzle surface 3*a*. Normally, it is in the first state when printing is performed in the printer 1.

In the embodiment, since the thermistor 65 is located at the opposite side from the inkjet head 3 with respect to the driver IC 62, the ways in which heat is transmitted from the driver IC 62 to the inkjet head 3 and to the thermistor 65 are different. The length L1 of the portion of the wiring member 64 from the thermistor 65 to the driver IC 62 is longer than the length L2 of the portion from the inkjet head 3 to the driver IC 62. Thus, transmission of heat from the driver IC 62 to the thermistor 65 takes longer time than transmission from the driver IC 62 to the inkjet head 3.

From these, as shown in FIG. 9, there is a period in which the temperature difference ΔT1 varies with time (the second state) from start of driving of the plurality of drive elements 50 by the driver IC 62 until becoming the first state.

In the present embodiment, as described above, while the three patterns 100, 110, and 120 are printed, the temperatures of the inkjet head 3 and the thermistor 65 rises and the state changes from the second state to the first state. When printing of the three patterns 100, 110, and 120 is completed, the controller 70 determines that the printer 1 has become the first state (an example of a determining process), and subsequently prints an ejection-timing adjusting pattern (droplet-landing-position adjusting pattern) 130 (S104).

Figure 10:
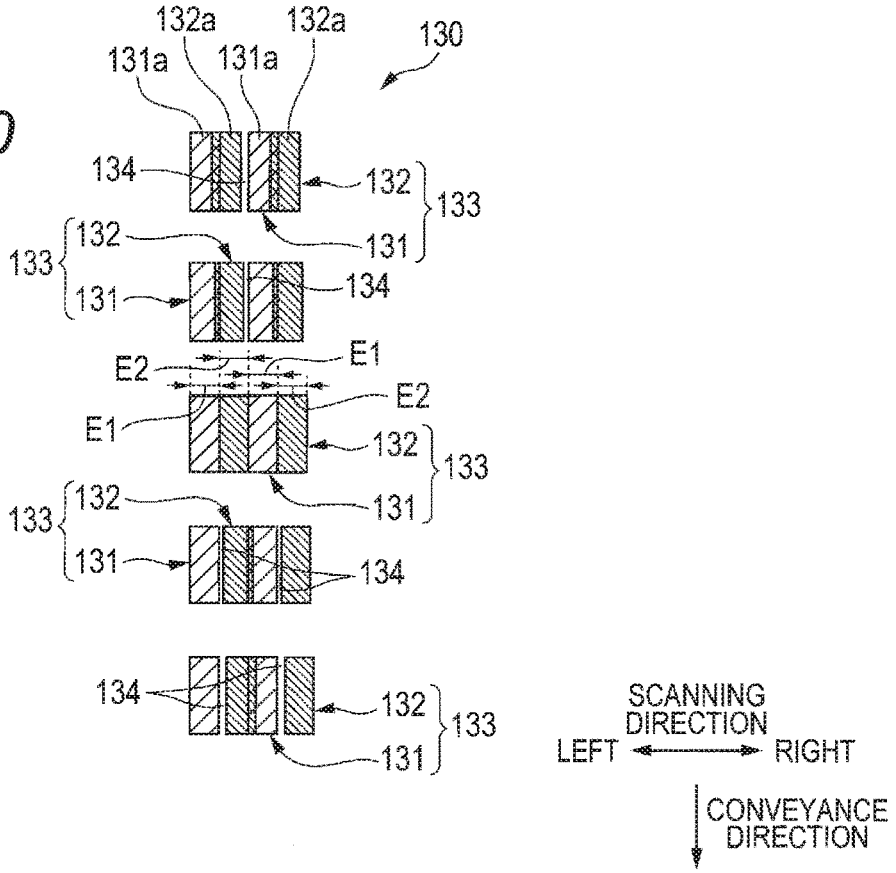
FIG. 10 is a diagram showing an ejection-timing adjusting pattern.

As shown in FIG. 10, the ejection-timing adjusting pattern 130 has a plurality of first portions 131 and a plurality of second portions 132 corresponding to the plurality of first portions 131. The plurality of first portions 131 is arranged in the conveyance direction. Each first portion 131 is formed by two rectangular portions 131*a*. Each of the two rectangular portions 131*a* is a portion of substantially a rectangular shape having a length E1 in the scanning direction. The two rectangular portions 131*a* are arranged with an interval therebetween in the scanning direction. The interval between the two rectangular portions 131*a* in the scanning direction is E2. Among the plurality of first portions 131, the positions of the rectangular portions 131*a* in the scanning direction are the same.

The plurality of second portions 132 is located at the same position as the plurality of first portions 131 in the conveyance direction. The plurality of second portions 132 is arranged in the conveyance direction. Each second portion 132 is formed by two rectangular portions 132*a*. Each of the two rectangular portions 132*a* is a portion of substantially a rectangular shape having a length E2 in the scanning direction. The two rectangular portions 132*a* are arranged with an interval therebetween in the scanning direction. The interval between the two rectangular portions 132*a* in the scanning direction is E1. Among the plurality of second portions 132, the positions of the rectangular portions 132*a* in the scanning direction are shifted from each other. Specifically, the rectangular portions 132*a* of the second portion 132 at the downstream side in the conveyance direction are located at the right side in the scanning direction. That is, the farther downstream side the second portion 132 is, the farther right side the second portion 132 is.

In order to print the ejection-timing adjusting pattern 130, first, one first portion 131 is printed by scan printing in which the carriage 2 is moved to the right side. Subsequently, without conveying the recording sheet P, one second portion 132 is printed by scan printing in which the carriage 2 is moved to the left side. By this operation, a set 133 of the first portion 131 and the second portion 132 corresponding to each other is printed.

Subsequently, after the recording sheet P is conveyed by the conveying rollers 4*a*, 4*b*, the first portion 131 and the second portion 132 are printed as described above. And, a similar operation is repeated. By this operation, the ejection-timing adjusting pattern 130 is printed in which the sets 133 of the first portion 131 and the second portion 132 are arranged in the conveyance direction. Note that, when the ejection-timing adjusting pattern 130 is printed as described above, ejection timing for printing the second portion 132 at the downstream side in the conveyance direction is advanced such that the rectangular portion 132*a* of the second portion 132 at the downstream side in the conveyance direction is printed at the right side.

The ejection-timing adjusting pattern 130 allows selecting, from among the plurality of sets 133, one set 133 having the rectangular portion 131*a* and the rectangular portion 132*a* arranged alternately in the scanning direction without overlapping, that is, one set 133 having no white streak 134 where ink does not land, between any rectangular portion 131*a* and rectangular portion 132*a* (the third set 133 from the upstream side in the conveyance direction in the example of FIG. 10). Based on which set 133 is selected, the ejection timing of ink from the nozzles 45 in bidirectional printing can be determined. As described above, normally, it is in the first state when printing is performed in the printer 1. From the print result of the ejection-timing adjusting pattern 130, the ejection timing of ink from the nozzles 45 in bidirectional printing in the first state is adjusted.

Figure 11:
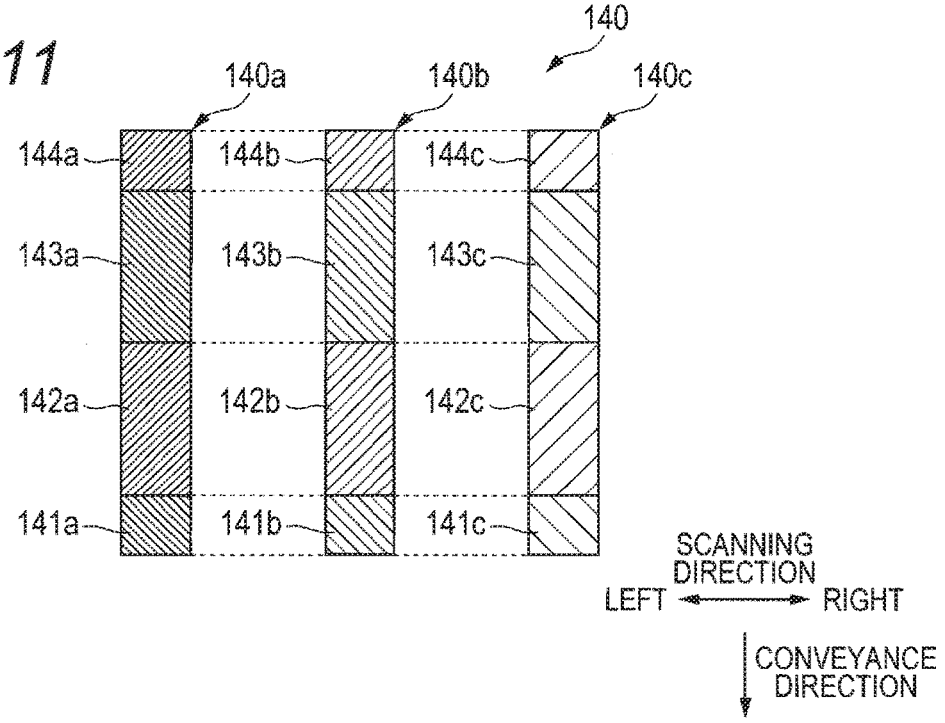
FIG. 11 is a diagram showing an ejection-amount adjusting pattern.

Returning to FIG. 5, the controller 70 subsequently controls to print an ejection-amount adjusting pattern (density adjusting pattern) 140 (S105). As shown in FIG. 11, the ejection-amount adjusting pattern 140 is formed by three patterns 140*a* to 140*c*. Here, the inkjet head 3 is configured to eject three kinds of ink of a large droplet, a medium droplet, and a small droplet having different volumes, from the plurality of nozzles 45. The three patterns 140*a* to 140*c* correspond to the large droplet, the medium droplet, and the small droplet, respectively. The ejection-amount adjusting pattern 140 is printed individually for each color of ink.

The pattern 140*a* has four portions 141*a* to 144*a*. The portion 141*a* is a filled portion that is formed by large droplets ejected from the nozzles 45 located at a center portion in the conveyance direction, out of the plurality of nozzles 45. The portion 142*a* is adjacent to the upstream side of the portion 141*a* in the conveyance direction. The portion 142*a* is a filled portion that is formed by large droplets ejected from all the nozzles 45. The portion 143*a* is adjacent to the upstream side of the portion 142*a* in the conveyance direction. The portion 143*a* is a filled portion that is formed by large droplets ejected from all the nozzles 45, like the portion 142*a*. The portion 144*a* is adjacent to the upstream side of the portion 143*a* in the conveyance direction. The portion 144*a* is a filled portion that is formed by large droplets ejected from the nozzles 45 located at the center portion in the conveyance direction, out of the plurality of nozzles 45.

The pattern 140*b* has four portions 141*b* to 144*b*. The portions 141*b* to 144*b* are located at the same positions as the portions 141*a* to 144*a*, respectively, in the conveyance direction. The portions 141*b* to 144*b* are filled portions that are formed by medium droplets ejected from the same nozzles 45 as used for printing the portions 141*a* to 144*a*, respectively.

The pattern 140*c* has four portions 141*c* to 144*c*. The portions 141*c* to 144*c* are located at the same positions as the portions 141*a* to 144*a*, respectively, in the conveyance direction. The portions 141*c* to 144*c* are filled portions that are formed by small droplets ejected from the same nozzles 45 as used for printing the portions 141*a* to 144*a*, respectively.

In order to print the ejection-amount adjusting pattern 140, first, the portions 141*a* to 141*c* are printed by scan printing, by ejecting ink from the nozzles 45 located at the center portion in the conveyance direction, out of the plurality of nozzles 45. Subsequently, after the recording sheet P is conveyed until the nozzle 45 at the farthest downstream side in the conveyance direction becomes adjacent to upstream ends of the portions 141*a* to 141*c*, the portions 142*a* to 142*c* are printed by scan printing by ejecting ink from all the nozzles 45. Subsequently, after the recording sheet P is conveyed in the conveyance direction by the length of the nozzle array 37, ink is ejected from all the nozzles 45 to print the portions 143*a* to 143*c* by scan printing. Subsequently, after the recording sheet P is conveyed until the nozzle 45 at the farthest downstream side in the conveyance direction, out of the nozzles 45 to be used for printing the portions 144*a* to 144*c*, becomes adjacent to upstream ends of the portions 143*a* to 143*c*, the portions 144*a* to 144*c* are printed by scan printing by ejecting ink from the nozzles 45 located at the center portion in the conveyance direction, out of the plurality of nozzles 45.

In the pattern 140*a*, the portion 141*a* formed by the nozzles 45 located at the center portion in the conveyance direction and the downstream end of the portion 142*a* formed by the nozzles 45 at the downstream side in the conveyance direction are juxtaposed in the conveyance direction. Further, in the pattern 140*a*, the portion 144*a* formed by the nozzles 45 located at the center portion in the conveyance direction and the upstream end of the portion 143*a* formed by the nozzles 45 at the upstream side in the conveyance direction are juxtaposed in the conveyance direction. Thus, in the pattern 140*a*, it is determined whether there is a large variation (difference) of density at a boundary between the portion 141*a* and the portion 142*a* and at a boundary between the portion 143*a* and the portion 144*a*. If there is a large variation of density at the boundary between the portion 141*a* and the portion 142*a*, the ejection amount of ink from the nozzles 45 at the downstream side is adjusted. If there is a large variation of density at the boundary between the portion 143*a* and the portion 144*a*, the ejection amount of ink from the nozzles 45 at the upstream side is adjusted. Adjustments of the ejection amount of ink are performed by adjusting driving potentials or driving waveforms for driving the drive elements 50, for example. Similar processes are performed for the patterns 140*b* and 140*c*.

Here, in the inkjet head 3, there is a case where the ink ejection amount of the nozzles 45 located at an outer side (upstream and downstream sides) in the conveyance direction is different from the ink ejection amount of the nozzles 45 located at the center in the conveyance direction. Hence, in the present embodiment, the ejection-amount adjusting pattern 140 is printed as described above and, as necessary, the ink ejection amount from the nozzles 45 at the upstream side or the downstream side is adjusted. As described above, normally, it is in the first state when printing is performed in the printer 1. From the print result of the ejection-amount adjusting pattern 140, the ejection amount of ink from the nozzles 45 in the first state is adjusted.

In the present embodiment, each of the patterns 130 and 140 is an example of a related-information acquisition pattern, and the information acquired from the pattern 130, 140 is an example of related information. Further, the process of the controller 70 for printing the pattern 130, 140 is an example of a pattern printing process.

In the present embodiment, each of the patterns 100, 110, 120, 130, and 140 is an example of a test pattern.

In scan printing, the driver IC 62 drives the plurality of drive elements 50 by the driving potential and driving waveform based on the thermistor temperature Ts. Assuming that the thermistor temperature Ts is the same, the head temperature Th is different between the first state and the second state. On the other hand, as the head temperature Th is higher, viscosity of ink in the inkjet head 3 is lower and the ink ejection speed from the nozzles 45 is higher when the drive elements 50 are driven in the same manner.

Based on these, the ink ejection speed from the nozzles 45 at the time of driving the drive elements 50 based on a certain thermistor temperature Ts in the second state is different from the ink ejection speed at the time of driving the drive elements 50 based on the same thermistor temperature Ts in the first state. Accordingly, the droplet landing positions of ink at the time of performing scan printing in the second state are deviated in the scanning direction from the droplet landing positions of ink at the time of performing scan printing in the first state. Hence, unlike the present embodiment, if the ejection-timing adjusting pattern 130 is printed in the second state and the ejection timing in bidirectional printing is adjusted based on that print result, the ejection timing in bidirectional printing in the first state cannot be adjusted appropriately.

Hence, in the present embodiment, as described above, after the state of the printer 1 is changed from the second state to the first state by printing the patterns 100, 110, and 120, the ejection-timing adjusting pattern 130 is printed. Thus, based on the print result of the ejection-timing adjusting pattern 130, the ejection timing in bidirectional printing in the first state can be determined appropriately.

In scan printing, the driver IC 62 drives the plurality of drive elements 50 by the driving potential and driving waveform determined based on the thermistor temperature Ts. Assuming that the thermistor temperature Ts is the same, the head temperature Th is different between the first state and the second state. On the other hand, as the head temperature Th is higher, viscosity of ink in the inkjet head 3 is lower and the ink ejection amount from the nozzles 45 is larger when the drive elements 50 are driven in the same manner.

Based on these, the ink ejection amount from the nozzles 45 at the time of driving the drive elements 50 based on a certain thermistor temperature Ts in the second state is different from the ink ejection amount at the time of driving the drive elements 50 based on the same thermistor temperature Ts in the first state. Accordingly, density of a printed image at the time of performing scan printing in the second state is different from density of a printed image at the time of performing scan printing in the first state. Hence, unlike the present embodiment, if the ejection-amount adjusting pattern 140 is printed in the second state and the ejection amount from the nozzles 45 is adjusted based on that print result, the ejection amount in the first state cannot be adjusted appropriately.

Hence, in the present embodiment, as described above, after the state of the printer 1 is changed from the second state to the first state by printing the patterns 100, 110, and 120, the ejection-amount adjusting pattern 140 is printed. Thus, based on the print result of the ejection-amount adjusting pattern 140, the ejection amount in the first state can be adjusted appropriately.

The positions of the rectangular portions 101*a* and 102*a* at the time of printing the conveyance-amount adjusting pattern 100 in the second state are deviated in the scanning direction from the positions of the rectangular portions 101*a* and 102*a* at the time of printing the conveyance-amount adjusting pattern 100 in the first state. However, even if the positions of the rectangular portions 101*a* and 102*a* are deviated in the scanning direction, the positional relationship between the first portion 101 and the second portion 102 in the conveyance direction does not change. Hence, the set 103 to be selected in the case of printing the conveyance-amount adjusting pattern 100 in the second state is the same as the set 103 to be selected in the case of printing the conveyance-amount adjusting pattern 100 in the first state. Accordingly, there is no problem even if the conveyance-amount adjusting pattern 100 is printed in the second state.

Further, the position of each portion 111 at the time of printing the non-ejection-nozzle checking pattern 110 in the second state is deviated in the scanning direction from the position of the corresponding portion 111 at the time of printing the non-ejection-nozzle checking pattern 110 in the first state. However, even if the position of each portion 111 is deviated in the scanning direction, it is unchanged whether each portion 111 is printed in the non-ejection-nozzle checking pattern 110. Accordingly, there is no problem even if the non-ejection-nozzle checking pattern 110 is printed in the second state.

Further, the position of each portion 121 at the time of printing the medium-sensor adjusting pattern 120 in the second state is deviated in the scanning direction from the position of the corresponding portion 121 at the time of printing the medium-sensor adjusting pattern 120 in the first state. However, even if the position of each portion 121 is deviated in the scanning direction, there is no change in a result that, assuming that the threshold of the medium sensor 6 is appropriate, the recording sheet P is not detected when the medium sensor 6 faces both end portions of the recording sheet P in the scanning direction, and the recording sheet P is detected when the medium sensor 6 faces the center portion of the recording sheet P in the scanning direction. Further, the density of each portion 121 at the time of printing the medium-sensor adjusting pattern 120 in the second state is slightly different from the density of the portion 121 at the time of printing the medium-sensor adjusting pattern 120 in the first state. However, the threshold is set to a value that is sufficiently larger than luminance acquired when the medium sensor 6 faces the portion 121. Accordingly, even if the density of the portion 121 is changed to some degree, there is no change in a determination result of whether the threshold needs to be adjusted. Based on the above, there is no problem even if the medium-sensor adjusting pattern 120 is printed in the second state.

While the disclosure has been described in detail with reference to the above aspects thereof, it would be apparent to those skilled in the art that various changes and modifications may be made therein without departing from the scope of the claims.

In the above-described embodiment, after the three patterns 100, 110, and 120 are printed, the ejection-timing adjusting pattern 130 and the ejection-amount adjusting pattern 140 are printed. However, printing of the patterns is not limited to this. After the three patterns 100, 110, and 120 are printed, only one of the ejection-timing adjusting pattern 130 and the ejection-amount adjusting pattern 140 may be printed. In this case, the printed pattern 130 or 140 is an example of the related-information acquisition pattern, and the information acquired from the printed pattern 130 or 140 is an example of the related information.

Further, after the three patterns 100, 110, and 120 are printed, the printer 1 may print a related-information acquisition pattern other than the patterns 130, 140 for acquiring related information relating to the ejection amount or droplet landing position of ink ejected from nozzles in scan printing.

In the above-described embodiment, after the three patterns 100, 110, and 120 are printed, the ejection-timing adjusting pattern 130 and the ejection-amount adjusting pattern 140 are printed. However, printing of the patterns is not limited to this. For example, if the state can be changed from the second state to the first state by printing a part of the three patterns 100, 110, and 120, the ejection-timing adjusting pattern 130 and the ejection-amount adjusting pattern 140 may be printed after printing the part of the three patterns 100, 110, and 120. In this case, after the ejection-timing adjusting pattern 130 and the ejection-amount adjusting pattern 140 are printed, remaining one(s) of the three patterns 100, 110, and 120 may be printed. In this case, the operation of printing the part of the three patterns 100, 110, and 120 is an example of a preparing operation, and the process of the controller 70 for performing this operation is an example of a preparing process.

Further, the test pattern printed before printing the ejection-timing adjusting pattern 130 is not limited to the patterns 100, 110, and 120. Before printing the ejection-timing adjusting pattern 130 and the ejection-amount adjusting pattern 140, the printer 1 may print such a test pattern (other than the patterns 100, 110, and 120) that information to be acquired is not changed by differences of the ink ejection amount and the droplet landing position in the scanning direction between printing in the first state and printing in the second state. In this case, the operation of printing the other test pattern is an example of the preparing operation, and the process of the controller 70 for performing this operation is an example of the preparing process.

In the above-described embodiment, the medium-sensor adjusting pattern 120 shown in FIG. 8 has one set of two portions 121 that are located at both end portions of the recording sheet P in the scanning direction. However, the medium-sensor adjusting pattern may be formed by conveying a recording sheet in the conveyance direction, thereby positioning the recording sheet at a plurality of positions including a position detected by the medium sensor 6, and performing the scan printing when the recording sheet is positioned at each of the plurality of positions. In this case, a plurality of sets of two portions 121 arranged in the conveyance direction is printed on the recording sheet, and the temperature of the inkjet head 3 can be increased.

In the above-described embodiment, the state is changed from the second state to the first state by causing the driver IC 62 to generate heat by printing another test pattern before printing the ejection-timing adjusting pattern. The operation for changing the state is not limited to this. For example, the state may be changed from the second state to the first state by causing the driver IC 62 to generate heat by driving the plurality of drive elements 50 to a degree that ink is not ejected from the nozzles 45. In this case, the operation of driving the plurality of drive elements 50 to a degree that ink is not ejected from the nozzles 45 is an example of the preparing operation, and the process of the controller 70 for performing this operation is an example of the preparing process.

Alternatively, the state may be changed from the second state to the first state by causing the driver IC 62 to generate heat by moving the carriage 2 to a position at which the plurality of nozzles 45 faces a nozzle cap (not shown) or an ink foam and, in this state, driving the plurality of drive elements 50 by the driver IC 62 to eject ink from the plurality of nozzles 45. In this case, the operation of driving the plurality of drive elements 50 to eject ink from the plurality of nozzles 45 is an example of the preparing operation, and the process of the controller 70 for performing this operation is an example of the preparing process.

In the above-described embodiment and modifications, the ejection-timing adjusting pattern is printed after the state is changed from the second state to the first state by driving the plurality of drive elements 50 by the driver IC 62. The method of changing the state is not limited to this. For example, a heater may be provided, and the state may be changed from the second state to the first state by heating the inkjet head 3, the driver IC 62, and the thermistor 65 with this heater to increase the temperature of these components.

In the above-described embodiment, it is determined to be in the first state when the temperature difference ΔT1 between the thermistor temperature Ts and the head temperature Th is constant, and it is determined to be in the second state when the temperature difference ΔT1 varies with time. However, determination of the first state and the second state is not limited to this.

As the above-described embodiment, the state where the temperature difference between the thermistor temperature Ts and the temperature in a part of the inkjet head is substantially constant (varies only in a range of ±1 degree Celsius or less) may be determined to be the first state. Alternatively, in a case where there is a temperature difference to some extent between a plurality of parts of the inkjet head, the state where the thermistor temperature becomes substantially equal to an average value of the temperature of the plurality of parts may be determined to be the first state.

Figure 12A:
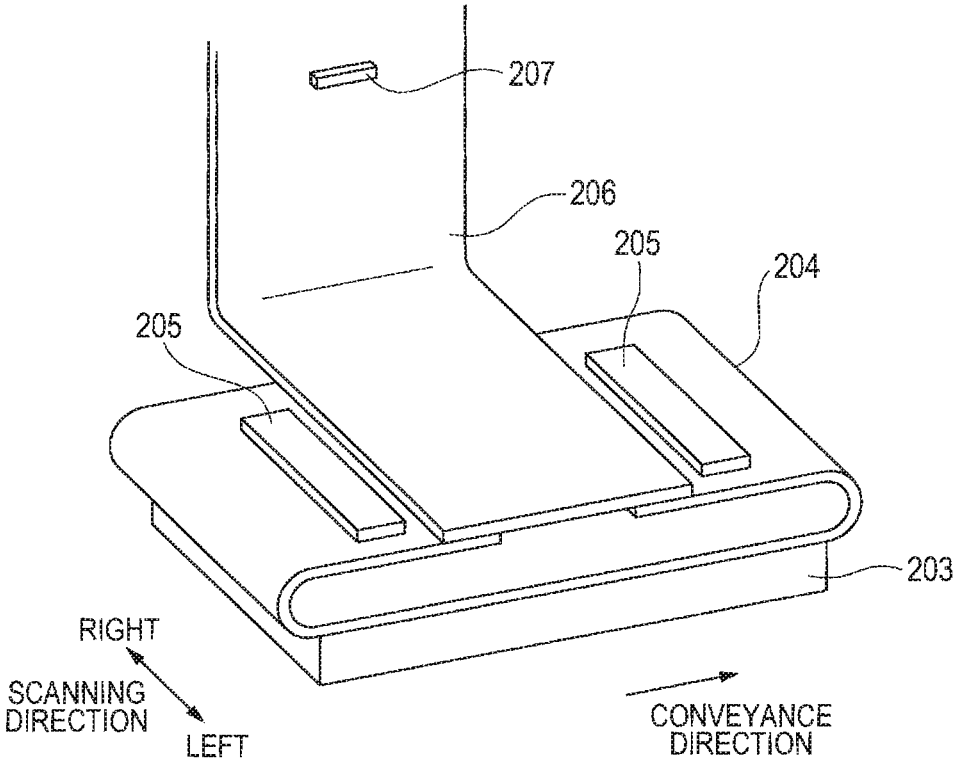
FIG. 12A is a perspective view showing a schematic configuration of an inkjet head according to a modification.

For example, in a modification, as shown in FIG. 12A, an inkjet head 203 is longer than the inkjet head 3 in the conveyance direction and has a larger number of the nozzles 45 (see FIG. 2) forming the nozzle array 37 (see FIG. 2). A COF 204 (an example of a first connecting member) arranged on the upper surface of the inkjet head 203 extends to the both sides in the conveyance direction from the inkjet head 203, and the both sides are bent slightly upward and are bent toward inside in the conveyance direction. Thereby, two end portions of the COF 204 are located substantially directly above the inkjet head 203 and are separated from each other in the conveyance direction. A driver IC 205 is formed on each of the two end portions of the COF 204. The driver IC 205 at the upstream side in the conveyance direction is for driving the drive elements 50 (see FIG. 2) corresponding to about a half number of the nozzles 45 at the upstream side among the plurality of nozzles 45 forming each nozzle array 37. The driver IC 205 at the downstream side in the conveyance direction is for driving the drive elements 50 (see FIG. 2) corresponding to about a half number of the nozzles 45 at the downstream side among the plurality of nozzles 45 forming each nozzle array 37. A common FPC 206 (an example of a second connecting member) is connected to the top surface of the two end portions of the COF 204. The FPC 206 extends to the right side in the scanning direction from the connection portion with the COF 204 and is bent upward. A thermistor 207 is arranged on a portion of the FPC 206 extending vertically. The thermistor 207 is arranged at such a position that the distance between the thermistor 207 and the driver IC 205 at the upstream side is the same as the distance between the thermistor 207 and the driver IC 205 at the downstream side.

In this case, heat generated by two driver ICs 205 is each transmitted to the inkjet head 203 and to the thermistor 207. In the inkjet head 203, ink flows into the manifold channel 41 (see FIG. 2) from the ink supply port 38 formed in the end portion of the upstream side in the conveyance direction. The ink having flowed into the manifold channel 41 flows from the upstream side to the downstream side in the conveyance direction in the manifold channel 41. At this time, the inkjet head 203 is cooled by ink near the ink supply port 38 of the manifold channel 41 in the end portion at the upstream side in the conveyance direction. Ink in the manifold channel 41 is heated by the inkjet head 203 when the ink flows from the upstream side to the downstream side in the conveyance direction. Therefore, the end portion of the inkjet head 203 at the downstream side in the conveyance direction is hard to be cooled by ink in the manifold channel 41. Therefore, as shown in FIG. 12B, a downstream-side head temperature Th2 that is the temperature of the end portion of the inkjet head 203 at the downstream side in the conveyance direction becomes higher than an upstream-side head temperature Th1 that is the temperature of the end portion at the upstream side.

Figure 12B:
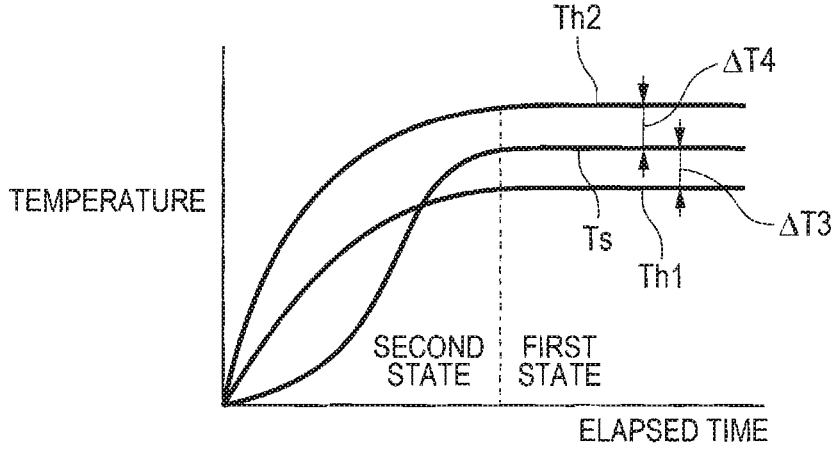
FIG. 12B is a diagram showing a relationship between elapsed time from start of driving of drive elements, and a thermistor temperature and actual temperatures of upstream and downstream end portions of the inkjet head in a conveyance direction according to the modification.

In this modification, when the plurality of drive elements 50 (see FIG. 3) is continued to be driven by two driver ICs 205, as shown in FIG. 12B, it eventually becomes the first state where the thermistor temperature Ts is substantially equal to the average value of the upstream-side head temperature Th1 that is the temperature in the end portion of the inkjet head 203 at the upstream side in the conveyance direction and the downstream-side head temperature Th2 that is the temperature of the end portion at the downstream side. That is, a temperature difference ΔT3 between the thermistor temperature Ts and the upstream-side head temperature Th1 and a temperature difference ΔT4 (=ΔT3) between the thermistor temperature Ts and the downstream-side head temperature Th2 are constant. On the other hand, a period from start of driving of the drive elements 50 until becoming the first state is a period of the second state where the thermistor temperature Ts is deviated from the average value of the upstream-side head temperature Th1 and the downstream-side head temperature Th2, because the temperature differences ΔT3 and ΔT4 vary with time. Therefore, in this case, too, it is preferable to print the ejection-timing adjusting pattern and the ejection-amount adjusting pattern after the state is changed to the first state, in a manner similar to the above.

In the above-described embodiment, this disclosure is applied to the printer having the inkjet head that eject ink from the nozzles communicating with the pressure chambers by deforming the vibration plate and the piezoelectric layer of the piezoelectric actuator to increase the pressure of ink in the pressure chambers. In this printer, the driver IC driving the piezoelectric actuators serves as a heat generator. However, this disclosure may be applied to another type of printer. For example, this disclosure may be applied to a printer including an inkjet head in which a heater for ejection is individually arranged for an ejection port of ink, as disclosed in Japanese Patent Application Publication No. 2016-43634. In this printer, the heater for ejection generates heat so that ink on the heater bubbles, and ink is ejected from the ejection port. In this case, the heater for ejection serves as a heat generator.

In the above-described embodiment, this disclosure is applied to the inkjet printer including a so-called serial head for printing by ejecting ink from the inkjet head while moving, in the scanning direction, the carriage on which the inkjet head is mounted. However, this disclosure may be applied to an inkjet printer having a so-called line head that is an inkjet head extending over an entire length in a direction perpendicular to the conveyance direction of a recording sheet. In the inkjet printer having the line head, printing is performed by ejecting ink from the line head, while the recording sheet is conveyed. If, in the second state, ink is ejected at the ejection timing determined to be suitable in the first state, the droplet landing position of ink is deviated in the conveyance direction. Therefore, in the inkjet printer having the line head, it is also effective to determine whether it is in the first state or in the second state and, when it is in the second state, to correct the ejection timing or the ejection speed. Alternatively, it is effective to determine whether it is in the first state or in the second state and, when it is in the second state, to correct the temperature detected by the thermistor and to determine the ejection timing or the ejection speed based on the corrected temperature.

Further, this disclosure can be applied to a printer that performs printing by ejecting liquid other than ink, such as a wiring pattern material to be printed on a wiring board.

What is claimed is:

1. A method of printing a test pattern in a printer including: a liquid ejection head having a plurality of nozzles and a plurality of drive elements configured to cause the plurality of nozzles to eject a liquid droplet; a heat generator that generates heat when the plurality of drive elements is driven; and a temperature sensor located at an opposite side from the liquid ejection head with respect to the heat generator, the method comprising:

printing a related-information acquisition pattern as the test pattern in a particular state by driving the plurality of drive elements to eject a liquid droplet from the plurality of nozzles based on the temperature detected by the temperature sensor, the related-information acquisition pattern being a pattern for acquiring related information relating to at least one of an ejection amount and a liquid droplet landing position of the liquid droplet ejected from each of the plurality of nozzles, the liquid droplet landing position being a position at which the liquid droplet ejected from each of the plurality of nozzles lands on a recording medium, the particular state being a state where a temperature difference between the temperature detected by the temperature sensor and an actual temperature of the liquid ejection head is constant over a period of time.

2. The method according to claim 1, further comprising:

determining whether the printer is in a first state that is the particular state or in a second state where the temperature difference varies with time.

3. The method according to claim 1, further comprising:

performing a preparing operation of changing a state of the printer from a second state to a first state by driving the plurality of drive elements to cause the heat generator to generate heat, the first state being the particular state, the second state being a state where the temperature difference varies with time; and printing the related-information acquisition pattern after completing the preparing operation.

4. The method according to claim 3, further comprising:

printing another pattern as the test pattern in the preparing operation, the another pattern being different from the related-information acquisition pattern, the another pattern is such a pattern that information acquired from the pattern is unchanged by a difference of the ejection amount and the liquid droplet landing position, the difference of the ejection amount and the liquid droplet landing position being caused by a temperature difference of the liquid ejection head.

5. The method according to claim 4, wherein the printer further includes: a conveyor configured to convey a recording medium in a conveyance direction; and a head moving device configured to move the liquid ejection head in a scanning direction intersecting the conveyance direction;

wherein the related-information acquisition pattern is a pattern for acquiring the related information in scan printing in which the liquid droplet is ejected from the plurality of nozzles while the head moving device moves the liquid ejection head in the scanning direction;

wherein the another pattern includes a conveyance-amount adjusting pattern for adjusting a conveyance amount by which a recording medium is conveyed by the conveyor; and wherein the preparing operation comprises printing the conveyance-amount adjusting pattern, the conveyance-amount adjusting pattern having a plurality of portions printed at different positions in the conveyance direction, the plurality of portions being printed by repeating the scan printing and conveyance of the recording medium by a small distance in the conveyance direction.

6. The method according to claim 4, wherein the another pattern includes a non-ejection-nozzle checking pattern for checking whether there is a non-ejection nozzle in the plurality of nozzles, the non-ejection nozzle being a nozzle from which the liquid droplet is not ejected.

7. The method according to claim 4, wherein the printer further includes: a conveyor configured to convey a recording medium in a conveyance direction; a head moving device configured to move the liquid ejection head in a scanning direction intersecting the conveyance direction; and a medium sensor configured to detect the recording medium that is conveyed by the conveyance device;

wherein the related-information acquisition pattern is a pattern for acquiring the related information in scan printing in which the liquid droplet is ejected from the plurality of nozzles while the head moving device moves the liquid ejection head in the scanning direction; and wherein the another pattern includes a medium-sensor adjusting pattern for adjusting sensitivity of the medium sensor.

8. The method according to claim 1, wherein the printer further includes: a conveyor configured to convey a recording medium in a conveyance direction; and a head moving device configured to move the liquid ejection head in a scanning direction intersecting the conveyance direction; and wherein the printing of the related-information acquisition pattern comprises:

printing a first portion by scan printing in which the liquid ejection head is moved to one side in the scanning direction and, without conveying the recording medium, printing a second portion by scan printing in which the liquid ejection head is moved to another side in the scanning direction, thereby printing a first set of the first portion and the second portion;

conveying the recording medium in the conveyance direction;

printing a second set of the first portion and the second portion, wherein ejection timing for printing the second portion of the second set is shifted from ejection timing of the second portion of the first set such that the second portion of the second set is printed at a position shifted from the second portion of the first set in the scanning direction, the ejection timing being timing at which the liquid droplet is ejected from the plurality of nozzles;

selecting, from among a plurality of sets including the first set and the second set, one set having the first portion and the second portion arranged in the scanning direction without overlapping and with no white streak where the liquid droplet does not land between the first portion and the second portion; and determining, based on which set is selected, the ejection timing in bidirectional printing.

9. The method according to claim 1, wherein the printer further includes: a conveyor configured to convey a recording medium in a conveyance direction; and a head moving device configured to move the liquid ejection head in a scanning direction intersecting the conveyance direction; and wherein the printing of the related-information acquisition pattern comprises:

printing a first portion by ejecting the liquid droplet from nozzles located at a center portion in the conveyance direction, out of the plurality of nozzles of the liquid ejection head;

conveying the recording medium by a particular amount;

printing a second portion by ejecting the liquid droplet from all of the plurality of nozzles of the liquid ejection head, such that the second portion is adjacent to the first portion in the conveyance direction;

determining whether there is a variation of density at a boundary between the first portion and the second portion; and in response to determining that there is a variation of density at the boundary, adjusting ejection amounts of nozzles corresponding to an end portion of the second portion in the conveyance direction, the end portion of the second portion being adjacent to the first portion.

10. A printer comprising:

a liquid ejection head having a plurality of nozzles and a plurality of drive elements configured to cause the plurality of nozzles to eject a liquid droplet;

a heat generator;

a temperature sensor located at an opposite side from the liquid ejection head with respect to the heat generator; and a controller configured to drive the plurality of drive elements to eject the liquid droplet from the plurality of nozzles based on a temperature detected by the temperature sensor, wherein the heat generator generates heat when the plurality of drive elements is driven; and wherein the controller is configured to:

perform a determining process of determining whether the printer is in a first state where a temperature difference between the temperature detected by the temperature sensor and an actual temperature of the liquid ejection head is constant over a period of time or in a second state where the temperature difference varies with time; and a pattern printing process of, after determining that the printer is in the first state in the determining process, controlling the liquid ejection head to print a related-information acquisition pattern as a test pattern, the related-information acquisition pattern being a pattern for acquiring related information relating to at least one of an ejection amount and a liquid droplet landing position of the liquid droplet ejected from each of the plurality of nozzles, the liquid droplet landing position being a position at which a liquid droplet ejected from each of the plurality of nozzles lands on a recording medium.

11. The printer according to claim 10, wherein the controller is configured to further perform, before the pattern printing process, a preparing process of changing a state of the printer from the second state to the first state by driving the plurality of drive elements to cause the heat generator to generate heat; and wherein the controller is configured to, in the determining process, determine that the printer is in the first state when the preparing process is completed.

12. The printer according to claim 11, wherein the controller is configured to further print, as the test pattern, another pattern different from the related-information acquisition pattern, the another pattern is such a pattern that information acquired from the pattern is unchanged by a difference of the ejection amount and the liquid droplet landing position, the difference of the ejection amount and the liquid droplet landing position being caused by a temperature difference of the liquid ejection head; and wherein the controller is configured to, in the preparing process, control the plurality of drive elements to eject the liquid droplet from the plurality of nozzles, thereby printing the another pattern.

13. The printer according to claim 12, further comprising:

a conveyor configured to convey a recording medium in a conveyance direction; and a head moving device configured to move the liquid ejection head in a scanning direction intersecting the conveyance direction, wherein the related-information acquisition pattern is a pattern for acquiring the related information in scan printing in which the liquid droplet is ejected from the plurality of nozzles while the head moving device moves the liquid ejection head in the scanning direction;

wherein the another pattern includes a conveyance-amount adjusting pattern for adjusting a conveyance amount by which a recording medium is conveyed by the conveyor; and wherein the controller is configured to print the conveyance-amount adjusting pattern in the preparing process, the conveyance-amount adjusting pattern having a plurality of portions printed at different positions in the conveyance direction, the plurality of portions being printed by repeating the scan printing and conveyance of the recording medium by a small distance in the conveyance direction.

14. The printer according to claim 12, wherein the another pattern includes a non-ejection-nozzle checking pattern for checking whether there is a non-ejection nozzle in the plurality of nozzles, the non-ejection nozzle being a nozzle from which the liquid droplet is not ejected.

15. The printer according to claim 12, further comprising:

a conveyor configured to convey a recording medium in a conveyance direction;

a head moving device configured to move the liquid ejection head in a scanning direction intersecting the conveyance direction; and a medium sensor configured to detect a leading end of the recording medium in the conveyance direction, wherein the related-information acquisition pattern is a pattern for acquiring the related information in scan printing in which the liquid droplet is ejected from the plurality of nozzles while the head moving device moves the liquid ejection head in the scanning direction;

wherein the another pattern includes a medium-sensor adjusting pattern for adjusting sensitivity of the medium sensor; and wherein the controller is configured to, in the preparing process:

control the conveyor to convey the recording medium in the conveyance direction, thereby positioning the recording medium at a plurality of positions including a position detected by the medium sensor; and perform the scan printing when the recording medium is positioned at each of the plurality of positions, thereby printing the medium-sensor adjusting pattern.

16. The printer according to claim 10, further comprising:

a conveyor configured to convey a recording medium in a conveyance direction; and a head moving device configured to move the liquid ejection head in a scanning direction intersecting the conveyance direction, wherein, in the pattern printing process, the controller is configured to perform:

printing a first portion by scan printing in which the liquid ejection head is moved to one side in the scanning direction and, without conveying the recording medium, printing a second portion by scan printing in which the liquid ejection head is moved to another side in the scanning direction, thereby printing a first set of the first portion and the second portion;

conveying the recording medium in the conveyance direction; and printing a second set of the first portion and the second portion, wherein ejection timing for printing the second portion of the second set is shifted from ejection timing of the second portion of the first set such that the second portion of the second set is printed at a position shifted from the second portion of the first set in the scanning direction, the ejection timing being timing at which the liquid droplet is ejected from the plurality of nozzles.

17. The printer according to claim 10, further comprising:

a conveyor configured to convey a recording medium in a conveyance direction; and a head moving device configured to move the liquid ejection head in a scanning direction intersecting the conveyance direction, wherein, in the pattern printing process, the controller is configured to perform:

printing a first portion by ejecting the liquid droplet from nozzles located at a center portion in the conveyance direction, out of the plurality of nozzles of the liquid ejection head;

conveying the recording medium by a particular amount; and printing a second portion by ejecting the liquid droplet from all of the plurality of nozzles of the liquid ejection head, such that the second portion is adjacent to the first portion in the conveyance direction.

18. A printer comprising:

a liquid ejection head having a plurality of nozzles and a plurality of drive elements configured to cause the plurality of nozzles to eject a liquid droplet;

a heat generator;

a temperature sensor located at an opposite side from the liquid ejection head with respect to the heat generator; and a controller configured to drive the plurality of drive elements to eject the liquid droplet from the plurality of nozzles based on a temperature detected by the temperature sensor, wherein the heat generator generates heat when the plurality of drive elements is driven; and wherein the controller is configured to:

perform a determining process of determining whether the printer is in a first state where a temperature difference between the temperature detected by the temperature sensor and an actual temperature of the liquid ejection head is constant or in a second state where the temperature difference varies with time; and a pattern printing process of, after determining that the printer is in the first state in the determining process, controlling the liquid ejection head to print a related-information acquisition pattern as a test pattern, the related-information acquisition pattern being a pattern for acquiring related information relating to at least one of an ejection amount and a liquid droplet landing position of the liquid droplet ejected from each of the plurality of nozzles, the liquid droplet landing position being a position at which a liquid droplet ejected from each of the plurality of nozzles lands on a recording medium, further comprising a connecting member that connects the liquid ejection head, the heat generator, and the temperature sensor, wherein the temperature sensor is arranged at an opposite side from the liquid ejection head with respect to the heat generator in a direction in which the connecting member extends;

wherein the connecting member comprises:

a first connecting member that is arranged on a surface of the liquid ejection head and that extends from upstream and downstream end portions of the liquid ejection head in a conveyance direction in which a recording medium is conveyed, thereby forming both end portions; and a second connecting member having one end connected to the both end portions of the first connecting member and another end connected to the controller;

wherein the heat generator comprises:

a first driver IC arranged on one of the both end portions of the first connecting member and configured to drive the plurality of drive elements corresponding to a half number of the plurality of nozzles at an upstream side in the conveyance direction; and a second driver IC arranged on another one of the both end portions of the first connecting member and configured to drive the plurality of drive elements corresponding to a half number of the plurality of nozzles at a downstream side in the conveyance direction; and wherein the temperature sensor is arranged on the second connecting member at a position where a distance between the temperature sensor and the first driver IC is same as a distance between the temperature sensor and the second driver IC, such that, in the first state, the temperature detected by the temperature sensor is substantially equal to an average value of an upstream-side head temperature that is a temperature in the upstream end portion of the liquid ejection head and a downstream-side head temperature that is a temperature in the downstream end portion of the liquid ejection head.

* * * * *